US009752295B2

(12) United States Patent
Heichel et al.

(10) Patent No.: US 9,752,295 B2
(45) Date of Patent: Sep. 5, 2017

(54) PILE HAMMER

(71) Applicant: DELMAG GmbH & Co. KG, Niedernberg (DE)

(72) Inventors: Matthias Heichel, Aschaffenburg (DE); Leopold Jerch, Babenhausen (DE)

(73) Assignee: DELMAG GmbH & Co. KG, Niedernberg (DE)

( * ) Notice: Subject to any disclaimer, the term of this patent is extended or adjusted under 35 U.S.C. 154(b) by 428 days.

(21) Appl. No.: 14/619,271

(22) Filed: Feb. 11, 2015

(65) Prior Publication Data

US 2015/0275457 A1 Oct. 1, 2015

(30) Foreign Application Priority Data

Mar. 28, 2014 (EP) ..... 14162396

(51) Int. Cl.
*E02D 7/12* (2006.01)

(52) U.S. Cl.
CPC ..... *E02D 7/125* (2013.01); *E02D 7/12* (2013.01)

(58) Field of Classification Search
CPC .. E02D 7/12; E02D 7/125; B25D 9/00; F01B 11/008; F01B 11/04; F02B 3/06
USPC ..... 173/128, 133, 135, 137, 138, 210, 211, 173/90, 200, 206, 209, 212; 227/9, 10, 227/129, 130; 123/46 R, 46 H, 46 SC
See application file for complete search history.

(56) References Cited

U.S. PATENT DOCUMENTS 2,558,165 A * 6/1951 Anderson ..... B25D 17/24 173/111
3,027,883 A * 4/1962 Lang ..... E02D 7/125 123/41.63
3,253,663 A * 5/1966 Burgess, Jr. ..... B06B 1/183 173/131
3,371,726 A * 3/1968 Bouyoucos ..... E21B 6/00 173/207
3,498,391 A * 3/1970 Goodman ..... E02D 13/10 173/131

(Continued)

FOREIGN PATENT DOCUMENTS

DE 837 080 C 4/1952
EP 0 040 810 A2 12/1981

OTHER PUBLICATIONS

European Search Report dated Oct. 14, 2014 in European Application No. 14162396.7 with English translation of the relevant parts.

*Primary Examiner* — Hemant M Desai
*Assistant Examiner* — William A Weller
(74) *Attorney, Agent, or Firm* — Collard & Roe, P.C.

(57) ABSTRACT

A pile hammer includes a cylinder, a piston displaceably guided in the cylinder, and a striker displaceably guided in the cylinder. The striker is disposed underneath the piston in the operating position of the pile hammer. A combustion chamber is delimited axially by a face surface of the striker that lies in the interior of the cylinder and by a face surface of the piston. Using at least one fuel feed device a predetermined amount of fuel can be introduced into the combustion chamber during each work cycle. An end ring is disposed on the cylinder for forming a capture groove. The piston is provided with a step that projects outward, which makes contact with the capture groove in the upper end position of the piston, and the end ring is elastically connected with the cylinder.

8 Claims, 2 Drawing Sheets

(56) References Cited

U.S. PATENT DOCUMENTS

| | | | | | |
|---|---|---|---|---|---|
| 4,121,671 | A * | 10/1978 | West | E02D 7/08 | 173/103 |
| 4,262,755 | A * | 4/1981 | Kuhn | E02D 7/10 | 173/131 |
| 4,428,565 | A | 1/1984 | Stiefel et al. | | |
| 5,117,924 | A * | 6/1992 | Bermingham | B25D 17/24 | 173/131 |
| 5,727,639 | A * | 3/1998 | Jeter | B25D 9/04 | 173/126 |
| 2009/0071672 | A1 * | 3/2009 | Heichel | E02D 7/125 | 173/209 |

* cited by examiner

PILE HAMMER

CROSS REFERENCE TO RELATED APPLICATIONS

Applicant claims priority under 35 U.S.C. §119 of European Application No. 14162396.7 filed Mar. 28, 2014, the disclosure of which is incorporated by reference.

BACKGROUND OF THE INVENTION

1. Field of the Invention

The invention relates to a pile hammer comprising a cylinder, a piston displaceably guided in the cylinder, and a striker displaceably guided in the cylinder.

2. Description of the Related Art

Such pile hammers, which are regularly also called diesel hammers or diesel pile drivers, are particularly used in foundation work in the construction industry. The pile hammers are used for driving posts of all kinds, such as concrete pillars, iron beams, sheet pile wall elements or the like into a construction ground.

To start such a pile hammer, the piston is pulled upward using a disengagement apparatus, and released at a specific height, thereupon dropping downward under the effect of gravity. As it drops, the piston activates a fuel pump, by way of which fuel, particularly diesel oil, is supplied to one or more injection nozzles, which inject the fuel into the combustion chamber of the cylinder. The air situated in the combustion chamber of the cylinder is compressed as the piston drops, and thereby heated so that the fuel/air mixture present in the working chamber is ignited, whereupon it combusts in the manner of an explosion. The explosion energy released during this process accelerates the piston back upward for a new work cycle, on the one hand; on the other hand, the material being pile-driven is driven into the ground.

When the piston is catapulted upward, it exits from the cylinder, which is open at the top, with its end during regular operation, before sliding downward again. Because of incomplete combustion in connection with disadvantageous ground properties, however, it cannot be precluded that such excessive energy acts on the piston during the explosion of the diesel/air mixture that the piston is catapulted completely out of the cylinder. This situation results in a significant hazard potential.

SUMMARY OF THE INVENTION

The invention seeks to provide a remedy for this situation. The invention is based on the task of making available a pile hammer in which catapulting of the piston out of the cylinder is effectively prevented. According to the invention, this task is accomplished by means of a pile hammer including a cylinder, a piston displaceably guided in the cylinder, and a striker displaceably guided in the cylinder. The striker is disposed underneath the piston in the operating position of the pile hammer. A combustion chamber is delimited axially by a face surface of the striker that lies in the interior of the cylinder and by a face surface of the piston. Using at least one fuel feed device, a predetermined amount of fuel can be introduced into the combustion chamber during each work cycle. An end ring is disposed on and elastically connected with the cylinder, by means of which a capture groove is formed. The piston is provided with a step that projects outward, which makes contact with the capture groove in the upper end of the piston.

With the invention, a pile hammer is made available in which catapulting of the piston out of the cylinder is effectively prevented. If the piston is moved too far out of the cylinder due to excessive energy, the capture piston ring of the piston or a step formed on in another manner or formed by an additional component, which step projects outward, makes contact with the capture groove formed by the end ring, thereby holding the piston back. Part of the movement energy of the piston is absorbed by means of the elastic connection of the end ring with the cylinder.

In a further development of the invention, the elastic connection of the end ring with the cylinder comprises an arrangement of friction springs. Such friction springs, as they are known, for example, from EP 0 040 810 A2, are characterized by a great ability to withstand static and dynamic stress, and by great damping capacity. By means of the arrangement of friction springs, conversion of up to ⅔ of the energy introduced into friction heat is made possible, thereby bringing about a resulting recoil force of only up to ⅓ of the spring force. As a result, catapulting out of the piston is prevented even when a significant energy excess is present.

In a further embodiment of the invention, a flange collar provided with bores is provided on the cylinder as well as on the end ring, on the end side, in each instance, which flange collars are connected with connection screws by means of their bores, which align with one another, wherein at least one guide that runs parallel to the cylinder is disposed on the underside of the flange collar of the cylinder that faces away from the end ring, in which guide a guide carriage is displaceably guided, through which carriage at least one of the connection screws is passed, wherein at least one arrangement of friction springs is disposed between guide carriage and flange collar of the cylinder. In this way, a sufficiently dimensioned arrangement of friction springs is made possible, thereby guaranteeing absorption of excessive movement energy of the piston.

In a further development of the invention, the guide carriage is configured to enclose the cylinder in ring shape. In this connection, the arrangement of friction springs is preferably configured in ring shape. As a result, great damping with simultaneously minimized construction space is made possible.

In a further embodiment of the invention, a slide bearing bushing is disposed in the cylinder to lie against the capture groove formed by the end ring. In this way, guided movement of piston and end ring is guaranteed as they move past the capture piston ring.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
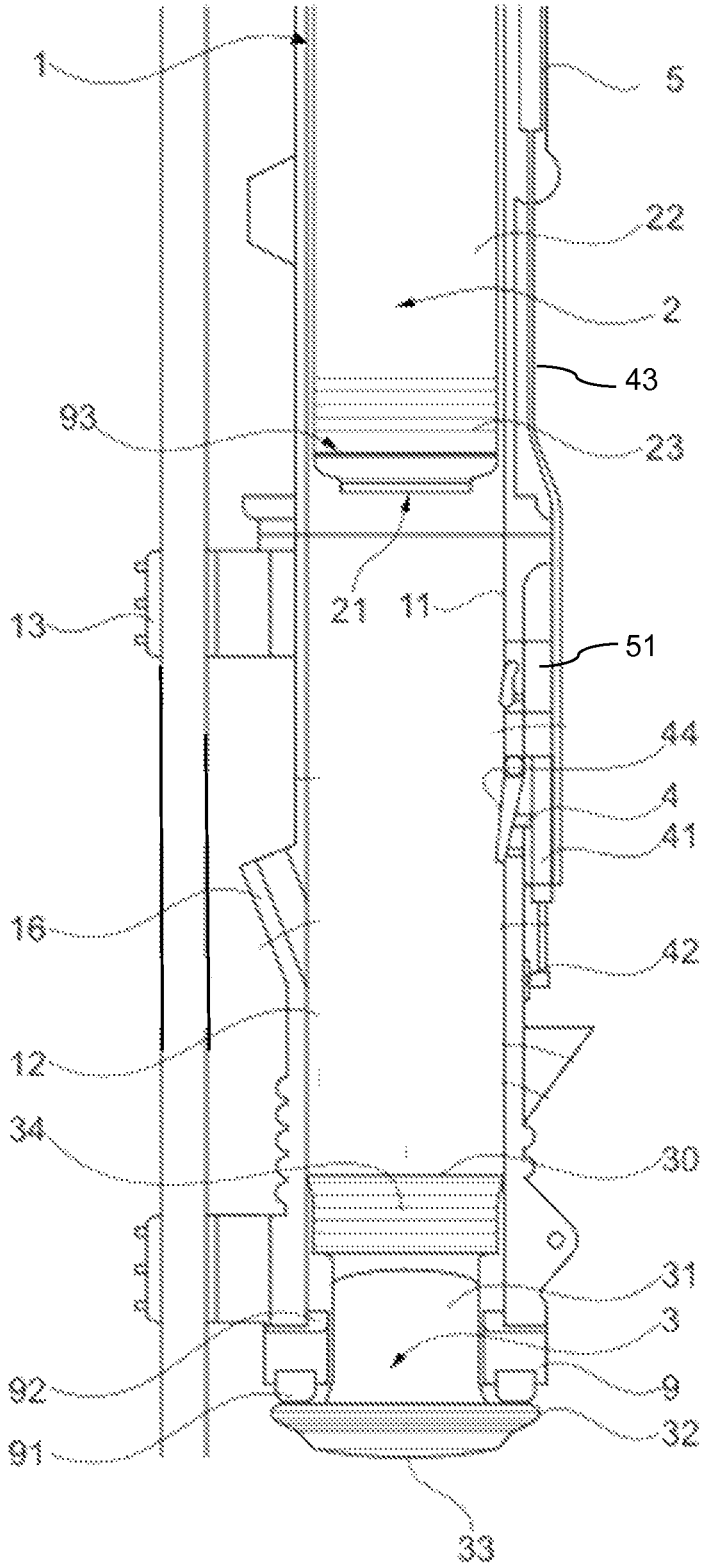
FIG. 1 is a schematic representation of a pile hammer in the form of a diesel hammer.

Referring now in detail to the drawings, the pile hammer shown in FIG. 1 selected as an exemplary embodiment comprises a cylinder 1 that is open on both sides, and regularly can have a length of 3 to 8 meters and a diameter of 0.2 to 1.5 meters. A piston 2 is displaceably disposed in the cylinder 1. A striker 3 coaxial to the piston 2 engages into the open lower end of the cylinder 1, in displaceable manner. A ring-shaped bearing unit 9 is attached at the lower end of the cylinder 1, in which unit a central shaft section 31 of the striker 3 is guided in tight and displaceable manner. Central shaft section 31 has an outside diameter that is reduced as compared with the inside diameter of the cylinder 1. The pile hammer is mounted so as to be vertically displaceable along a leader, by way of guide jaws 13 disposed on the cylinder 1.

A striker plate 32 that lies below the cylinder 1 is formed onto the lower end of the shaft section 31, the lower convex delimitation surface 33 of which plate, directed outward, interacts with the upper end of a material to be pile-driven, for example a sheet pile wall element, during operation.

A piston section 34 having multiple circumferential sealing rings, spaced apart from one another axially, which run on the inner mantle surface 11 of the cylinder 1, is formed onto the upper end of the shaft section 31 of the striker 3. A combustion chamber 12 is delimited by the top of the piston section 34 of the striker 3, together with the underside of the piston 2 as well as the inner mantle surface 11 of the cylinder 1. The face surface of the striker 3 that faces the combustion chamber 12 of the cylinder 1 is ground to be planar with a flat fuel bowl 30.

A damping ring 91 is disposed between the striker plate 32 of the striker 3 and the bearing unit 9 of the cylinder 1. A further damping ring 92 is disposed adjacent to the bearing unit 9, between the top of the bearing unit 9 and the underside of the piston section 34 of the striker 3.

A lower working end 23 of the piston 2, provided with circumferential sealing rings 93 spaced apart from one another axially, runs in the interior of the piston 1, above the striker 3. The lower free face surface 21 of the piston 2, which is ground to be planar, is set off by means of a radially circumferential step.

Figure 2:
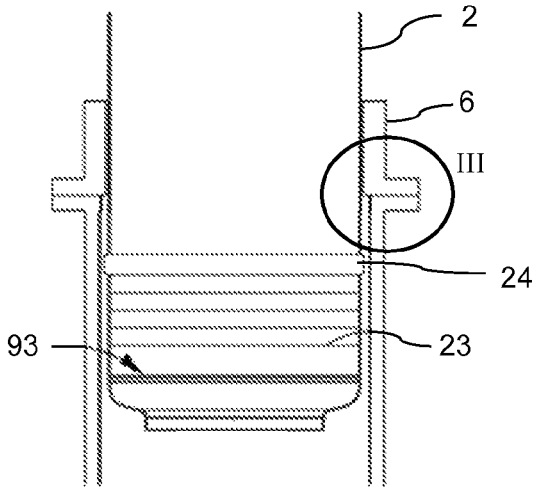
FIG. 2 is a schematic representation of the piston end impact region of the pile hammer from FIG. 1, with the flange connection of the end ring indicated.

A mass section 22 that extends into the upper section of the cylinder 1 is formed onto the lower working end 23 of the piston 2. A capture piston ring 24 (FIG. 2) is disposed on the piston 2 at the lower end of the mass section 22, the outside diameter of which ring projects beyond the outside diameter of the piston 2 in this region.

An injection apparatus 4 is disposed on the circumference wall of the cylinder 1, which apparatus comprises a fuel pump 41 that is connected with the injection nozzle 42 by way of a line 43. The inlet of the fuel pump 41 is supplied with diesel oil by way of a fuel tank 5.

The fuel pump 41, connected with the fuel tank 5 by way of the line 43, has a biased pump lever 44 that projects into the interior of the cylinder 1, by way of which lever the pump is driven as the dropping piston 2 moves past it. The injection nozzle 42 is configured and oriented in such a manner that the fuel emitted is sprayed approximately onto the center of the face surface of the striker 3 in an essentially cohesive stream.

Furthermore, a lubricant pump 51 is disposed on the cylinder 1, which pump is connected with lubricant nozzles distributed in the circumference direction of the cylinder 1. The lubricant is dispensed between the piston 2 and the inner mantle surface 11 of the cylinder 1 by means of the lubricant nozzles.

Figure 3:
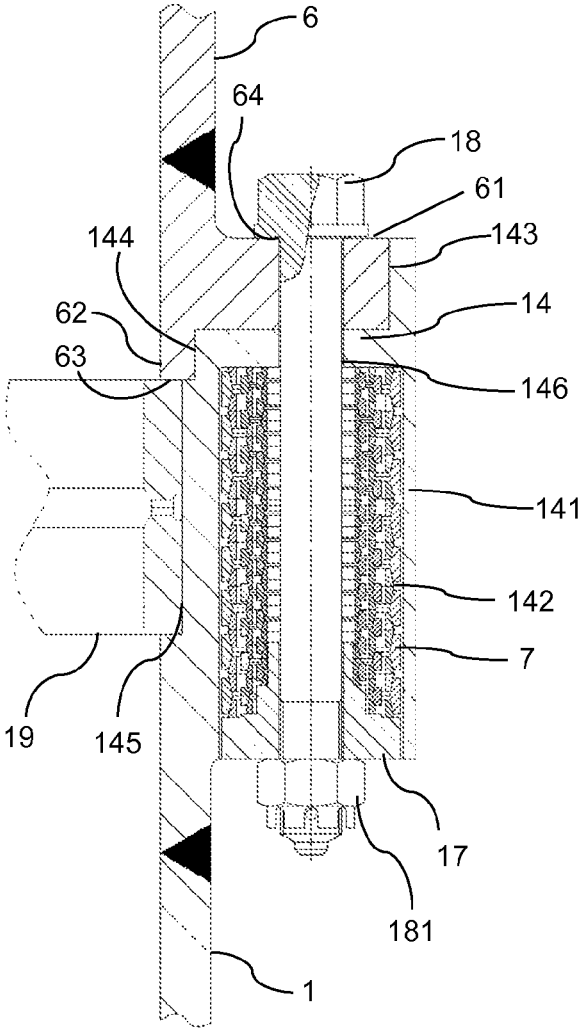
FIG. 3 is a detail representation of Detail III from FIG. 2.

At its open end that lies opposite the striker 3, a circumferential flange part 14 shown in FIG. 3 that extends radially outward is disposed on the cylinder 1. The flange part 14 ends in a cylinder piece 141 that lies orthogonal to it, by means of which a flange accommodation 143 for the flange 61 of the end ring 6 is formed on one side of the spring accommodation 142 as well as on the opposite side. Furthermore, a circumferential groove 144 for accommodating the circumferential projection 62 of the end ring 6 is introduced into the inner wall of the cylinder 1 at the level of the flange part 14. Furthermore, a bearing groove 145 is disposed below the groove 144, in the inner wall of the cylinder 1, which groove accommodates a slide bearing bushing 19, which lies against the projection 62 of the end ring 6.

The end ring 6 is configured essentially as a hollow cylinder and has a flange 61 that projects radially outward at a distance from its end facing the cylinder 1, thereby forming a circumferential projection 62 below the flange 61. The projection 62 makes contact in the groove 144 of the cylinder 1, whereby the projection 62 projects inward beyond the groove 144, thereby in turn forming a capture groove 63 against which the slide bearing bushing 19 lies. Bores 64, 146 that correspond with one another, in each instance, are introduced into the circumferential flange 61 of the end ring 6 as well as into the circumferential flange part 14 of the cylinder 1, through which bores the screws 18 are passed.

A ring-shaped friction spring package 7 is disposed in the flange accommodation 143 formed by the flange part 14 as well as the cylinder piece 141, which package lies on a carriage 17 on the side opposite the flange part 14, which carriage is disposed so as to be displaceable between the outer mantle of the cylinder 1 and the inner mantle of the cylinder piece 141. The friction spring package 7 as well as the carriage 17 are provided with bores that correspond to the bores 146 of the flange part 14 and align with them, in which bores screws 18 are guided. A nut 181 is screwed onto each of the screws 18, by way of which the carriage 17 is biased against the friction spring package 7, which lies against the flange part 14.

The pile hammer described above works as follows: In the starting state, the piston 2 is raised into an upper position by way of a disengagement apparatus—not shown. After disengagement of the piston 2, the piston 2 falls downward under the effect of gravity, closes the working connectors 16, and activates the pump lever 44 of the injection apparatus 4 with its face surface 21, thereby causing the injection nozzle 42 to spray fuel onto the fuel bowl 30 of the striker 3. Here, an ignitable mixture of fuel droplets and air is formed by means of impact atomization. When the piston 2 impacts the striker 3, a force directed downward is exerted on the material to be pile-driven, by means of and by way of the striker 3, which force drives the material to be pile-driven further into the ground.

During the subsequent upward movement of the piston 2, triggered by the explosion-like combustion of the fuel, the piston releases the working connectors 16 again, thereby causing the combustion gases to relax and to flow away by way of the working connectors 16. The piston 2 is now accelerated further upward, drawing fresh air in through the working connectors 16, until it has reached its upper end position and the work cycle, as described, is repeated.

In the event that combustion of the fuel took place only partially during the above-mentioned work cycle, an excessive amount of fuel, possibly supplemented with excess lubricant oil, is available for the subsequent combustion process. As a result of the subsequent explosion-like combustion of the excessive fuel, the piston is accelerated upward with excessive energy, thereby moving it beyond the upper position. In this connection, the capture piston ring 24 makes contact with the slide bearing bushing 19, and, with the bushing, with the capture groove 63. As a result, the end ring 6 is torn along upward, with the screws 18 passed through the bores 146 of the flange part 14. By way of the screws 18 with the nuts 181 disposed on them, the carriage 17 is drawn against the friction spring package 7, which absorbs a large part of the kinetic energy and converts it to heat energy. By way of the reset forces of the friction spring package 7, the screws 18 and, with them, the end ring 6 are moved back into their original position, whereupon the captured piston 2 drops downward for the next work cycle, under the effect of gravity.

Although only a few embodiments of the present invention have been shown and described, it is to be understood that many changes and modifications may be made thereunto without departing from the spirit and scope of the invention.

What is claimed is:

1. A pile hammer comprising:

(a) a cylinder having an interior;

(b) a piston displaceably guided in the cylinder and having a piston face surface;

(c) a striker displaceably guided in the cylinder and disposed underneath the piston in an operating position, said striker having a striker face surface lying in the interior of the cylinder;

(d) a combustion chamber delimited axially by the striker face surface and by the piston face surface;

(e) at least one fuel feed device for introduction of a predetermined amount of fuel into the combustion chamber during each work cycle; and (f) an end ring disposed on the cylinder and forming a capture groove;

wherein the piston is provided with an outwardly-projecting step that makes contact with the capture groove in an upper end position of the piston; and wherein the end ring is elastically connected with the cylinder.

2. The pile hammer according to claim 1, wherein the piston is provided with a capture piston ring for forming the outwardly-projecting step.

3. The pile hammer according to claim 1, wherein an arrangement of friction springs elastically connects the end ring with the cylinder.

4. The pile hammer according to claim 3, further comprising first and second flange collars provided with first and second bores, respectively, wherein the first flange collar is provided on the cylinder and the second flange collar is provided on an end side of the end ring, wherein the first and second flange collars are connected with screws through the first and second bores, the first and second bores aligning with one another, wherein at least one spring accommodation that runs parallel to the cylinder is disposed on an underside of the first flange collar that faces away from the end ring, wherein a guide carriage is displaceably guided in the at least one spring accommodation and at least one of the first and second screws is passed through the guide carriage, and wherein at least one arrangement of friction springs is disposed between the guide carriage and the first flange collar.

5. The pile hammer according to claim 4, wherein the guide carriage is configured to enclose the cylinder in ring shape.

6. The pile hammer according to claim 4, wherein the at least one arrangement of friction springs is configured in ring shape.

7. The pile hammer according to claim 5, wherein the at least one arrangement of friction springs is configured in ring shape.

8. The pile hammer according to claim 1, further comprising a slide bearing bushing disposed in the cylinder so as to lie against the capture groove formed by the end ring.

* * * * *